United States Patent [19]

Bach

[11] Patent Number: 4,904,489

[45] Date of Patent: Feb. 27, 1990

[54] PACKAGE FOR CONVECTION HEATING OF FOOD

[76] Inventor: Bert R. Bach, 21 Park La., Minneapolis, Minn. 55416

[21] Appl. No.: 223,223

[22] Filed: Jul. 22, 1988

[51] Int. Cl.[4] ..... B65D 85/00

[52] U.S. Cl. ..... 426/111; 99/359; 99/426; 426/113; 426/124; 426/412; 383/120; 383/100

[58] Field of Search ..... 99/359, 426, 427; 383/104, 100, 120, 122, 36, 47, 53; 206/525; 426/111, 403, 113, 412, 523, 124

[56] References Cited

U.S. PATENT DOCUMENTS

| | | | |
|---|---|---|---|
| 507,778 | 10/1893 | Blits | 99/359 |
| 1,985,904 | 1/1935 | Murch | 99/11 |
| 2,562,389 | 7/1951 | Piazze | 383/53 |
| 2,777,769 | 1/1957 | Hodges | 99/172 |
| 3,038,463 | 6/1962 | Daymon | 126/270 |
| 3,220,856 | 11/1965 | Vischer, Jr. | 99/192 |
| 3,418,453 | 12/1968 | Sparks | 219/400 |
| 3,432,087 | 3/1969 | Costello | 426/113 X |
| 3,603,240 | 9/1971 | McCarthy | 99/359 X |
| 3,610,881 | 10/1971 | Stewart | 219/370 |
| 3,741,778 | 6/1973 | Rowe | 426/113 X |
| 3,945,534 | 3/1976 | Ady | 426/523 X |
| 3,973,045 | 8/1976 | Brandberg et al. | 383/120 X |
| 4,081,942 | 4/1978 | Johnson | 426/412 X |
| 4,112,919 | 9/1978 | Davis | 126/270 |
| 4,126,775 | 11/1978 | Wyatt | 219/400 |
| 4,199,873 | 4/1980 | Hansen et al. | 34/202 |
| 4,323,586 | 4/1982 | Long | 426/412 |
| 4,374,318 | 2/1983 | Gilliom | 219/400 |
| 4,375,184 | 3/1983 | Gilliom | 99/422 |
| 4,381,443 | 4/1983 | Guibert | 219/400 |
| 4,439,459 | 3/1984 | Swartley | 426/438 |
| 4,450,180 | 5/1984 | Watkins | 426/107 |
| 4,491,065 | 1/1985 | Poulson | 99/327 |
| 4,529,089 | 7/1985 | Gasbarra et al. | 206/525 |
| 4,581,989 | 4/1986 | Swartley | 99/346 |
| 4,691,374 | 9/1987 | Watkins et al. | 383/104 |
| 4,734,288 | 3/1988 | Engstrom et al. | 383/100 X |
| 4,746,060 | 5/1988 | Morehouse | 426/111 X |

*Primary Examiner*—Stephen Marcus
*Assistant Examiner*—Christine A. Peterson
*Attorney, Agent, or Firm*—Kinney & Lange

[57] ABSTRACT

A heating system for heating food provides a heated forced air source and a food package including an air circulating bag for convection heating of the food. The food package can include an interior food storage pouch which is not exposed to direct impingement by the circulating air preventing cooking oils or smoke from the mixing with the circulating air flow.

11 Claims, 5 Drawing Sheets

Fig. 7b
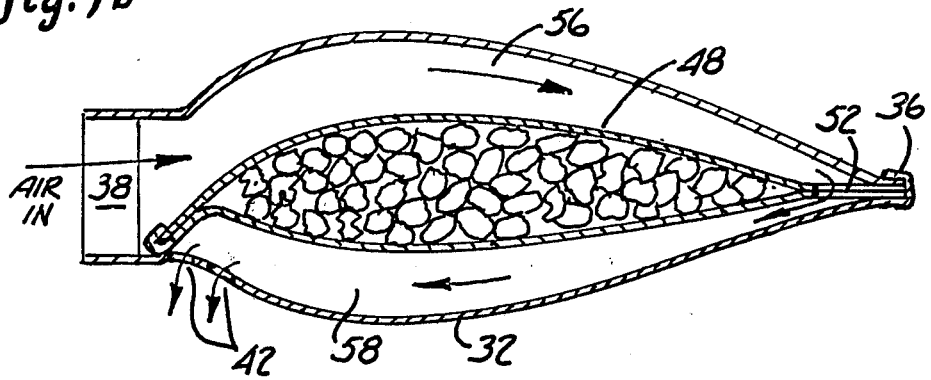
Fig. 8
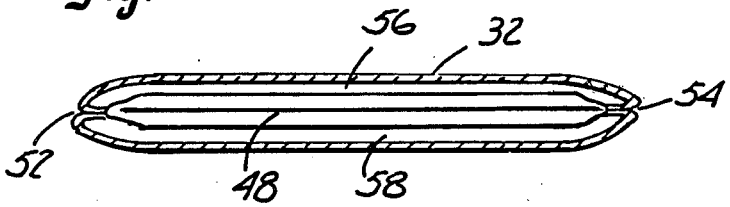
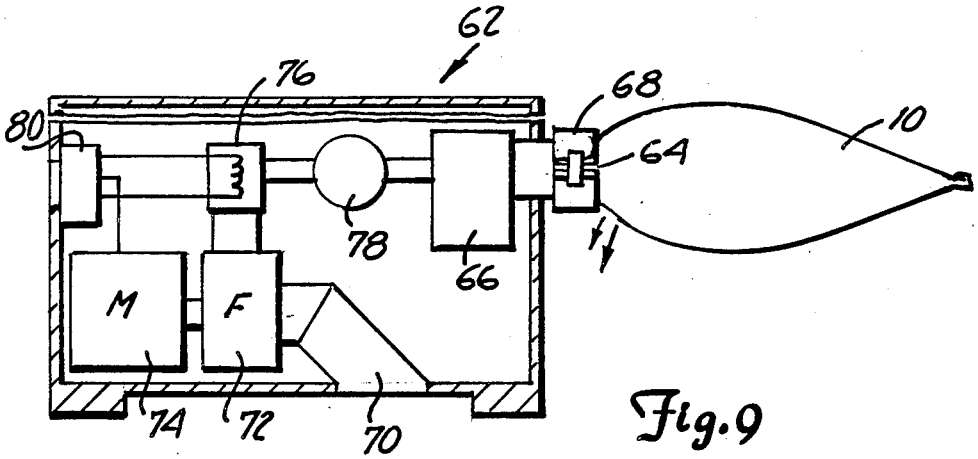
Fig. 9

PACKAGE FOR CONVECTION HEATING OF FOOD

BACKGROUND OF THE INVENTION

1. Field of the Invention

The invention relates to packaging for the transportation and heating of food and more particularly to disposable packaging for convection cooking of frozen foods when attached to a source of forced heated air.

2. Description of the Prior Art

The demand for variety in convenience frozen foods has engendered a seemingly endless flow of products from manufacturers. The often voiced criticism of many of these products respects their lack of traditional qualities of taste and texture. This criticism is typically directed to frozen foods heated in microwave ovens, but is also heard with respect to frozen foods cooked in conventional ovens.

The manner in which microwaves heat food and the packaging of frozen foods are two central problems in this area. Microwaves heat food substantially evenly throughout the body of the food, rather than from the outside in. Metallic packaging used in conventional ovens allows air to be exposed to one face only of the food. For foods such as french fried potatoes, more traditional results are obtained if the food is exposed to a flow of heating air which impinges all surfaces of the individual cuts of the potatotes. Cooking of food by flowing, heated air is known as convection heating.

Convection heating of french fried potatoes, and the superior results it affords are known. In U.S. Pat. No. 4,375,184, issued Mar. 1, 1983 to Gilliom, a disposable receptacle suitable for holding food during cooking and for serving of the food, especially french fried potatoes is disclosed. The receptacle is intended to provide a pan for heating the food and a plate for serving the food. It does not appear, however, that the receptacle is suitable for shipping of the frozen food. Nor does the device taught by Gilliom function as a circulating plenum for convection cooking.

SUMMARY OF THE INVENTION

The present invention provides a package for shipping of food. The package provides for the convection heating of food when the package is connected to a source of forced heated air. The package includes a bag formed from an expansible, flexible sheet material defining a substantially closed plenum for the circulation of heated forced air. The flexible sheet material can be pleated to allow for expansion of the bag under air pressure.

One edge of the bag is adapted to be opened and the opening temporarily sealed around an outlet from the source of heated forced air for admitting heated air to the plenum.

A plurality of relatively small holes are provided through the bag to provide an exhaust vent for air from the bag. The holes are small enough to ensure that passage of air from the bag is partially restricted. This ensures that pressure within the bag exceeds ambient pressure and that the bag inflates when attached to the source of heated air. For shipping, the holes are closed by a piece of removable tape.

The package has two preferred embodiments. Description of the first embodiment is essentially complete as described immediately above. The exhaust holes are disposed along the edge removed from the edge provided for sealing around the hot air outlet allowing circulation of the forced heated air throughout the bag. Frozen food is placed in the circulation plenum.

The second embodiment includes certain additional features. A food pouch is provided within the circulation plenum for holding the food. The pouch is made of a conductive material, such as aluminum foil. The pouch is used where the food to be cooked requires or tastes better when cooked in oil. The pouch prevents oil particles from becoming airborne with the attendant safety and cleanliness problems attendant thereto. The pouch also retains moisture if this is desirable for food flavor and texture.

The food pouch divides the circulation plenum into two chambers. The first chamber is adapted to be sealed around an outlet of heated air. The first chamber is connected to allow air circulation from the first chamber to the second chamber. An exhaust vent is provided from the second chamber in the same manner as described above except that the holes are disposed so that air circulates fully through the second chamber before being exhausted.

The heated forced air source is adapted to exploit advantages of the novel packaging in either described embodiment. Air is expelled from the heated air source through a turning valve, which is rotated during operation to turn the package during cooking. This tumbles the food providing for substantially even cooking of the food from all surfaces of the exterior toward the interior. Thus, food is evenly browned during cooking.

Figure 1:
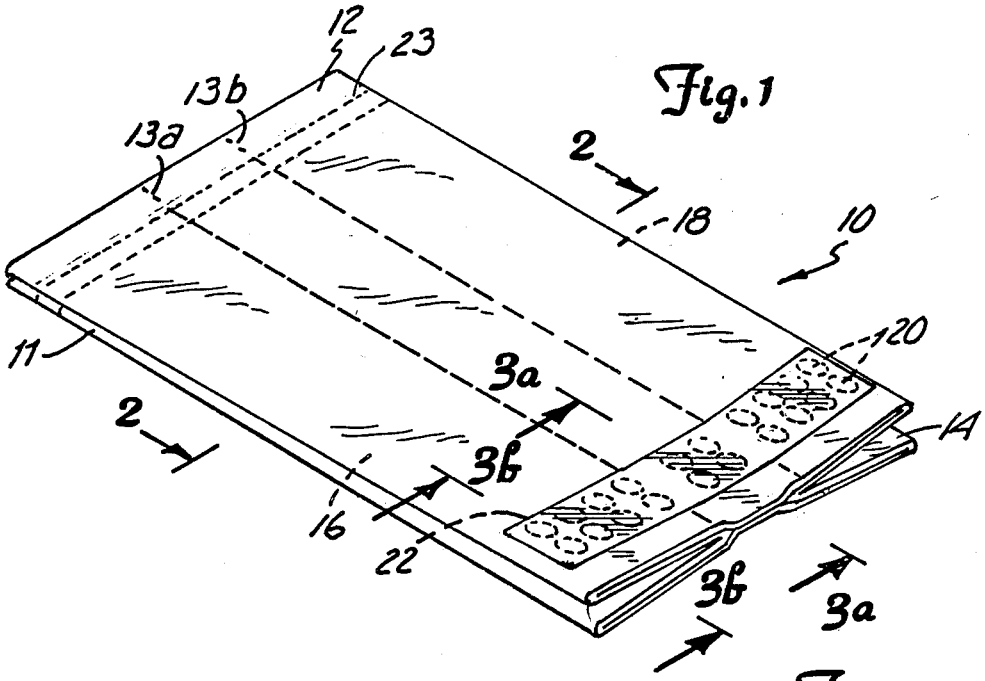
FIG. 1 is a perspective view of a first preferred embodiment of the package of the present invention.

FIG. *2a* is a cross sectional view of the package depicted in FIG. 1 taken along section line *2a—2a*.

FIG. *2b* is a cross sectional view of the package expanded into a cooking plenum under air pressure from a forced air source.

FIG. *3a* is a cross sectional view taken along section line *3a—3a* of FIG. 1.

FIG. *3b* is a cross sectional view taken along section line *3b—3b* of FIG. 1.

Figure 4:
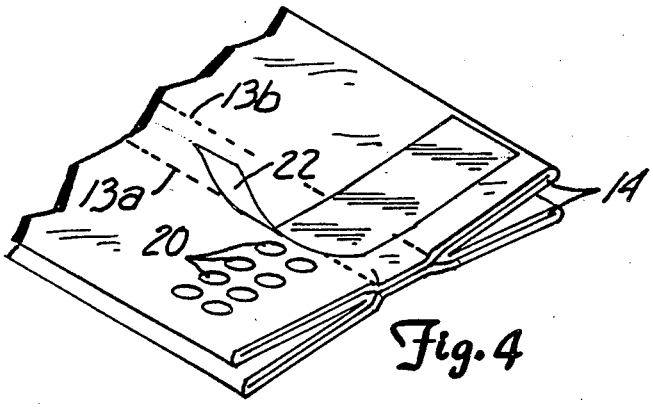

FIG. 4 is a detailed view of the exhaust holes of the first and second embodiments of the packages.

Figure 5:
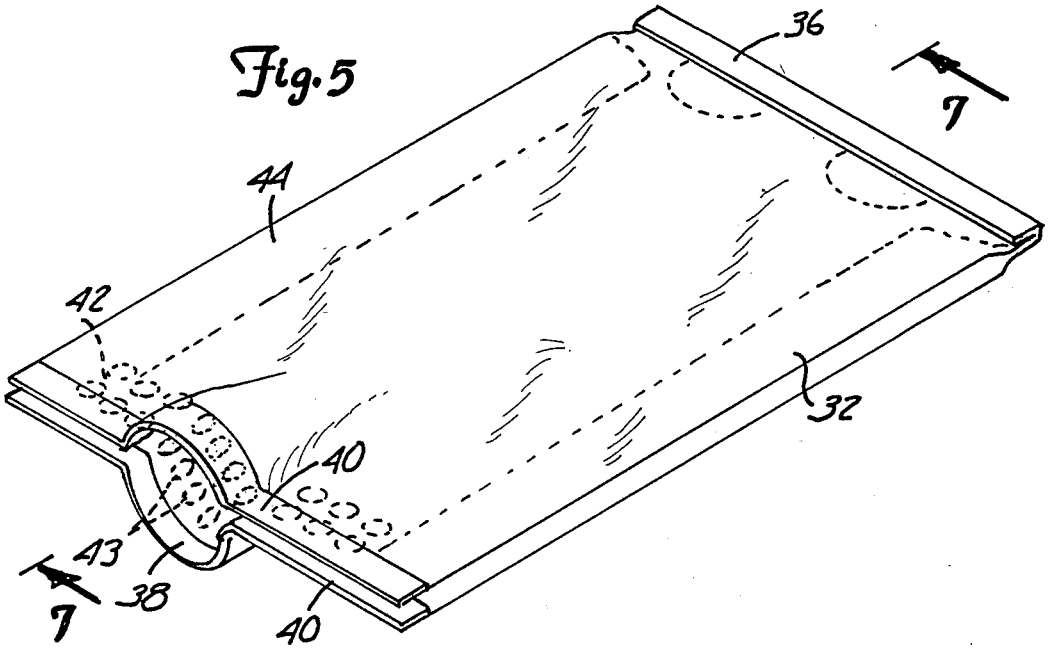

FIG. 5 is a perspective view of the exterior of a second preferred embodiment of the package of the present invention.

Figure 6:
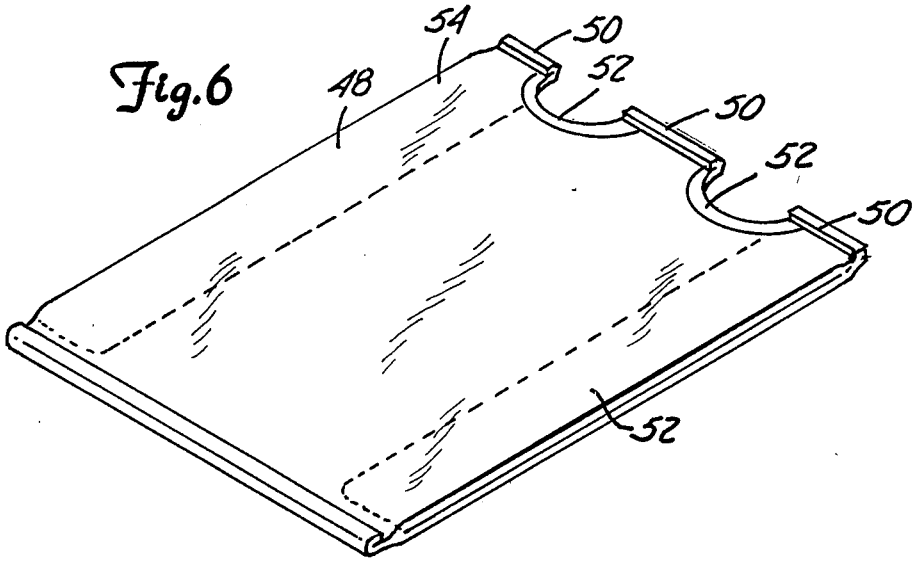

FIG. 6 is a perspective view of a food pouch used within exterior bag of the second preferred embodiment of the invention.

FIG. *7a* is a cross sectional view of the package of the second preferred embodiment taken along section line *7a—7a* in FIG. 5.

FIB. *7b* is a cross sectional view of the package of the second preferred embodiment during cooking.

FIG. 8 is a cross sectional view taken along line 8—8 in FIG. 5.

FIG. 9 is a schematic of a hot air source used in combination with either embodiment of the package.

Figure 10:
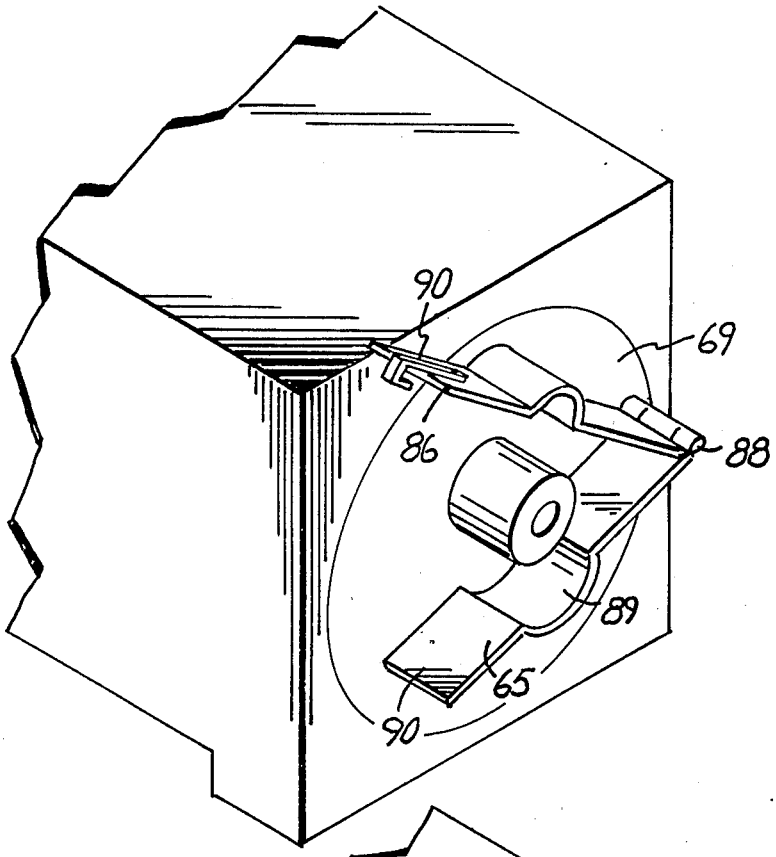

FIG. 10 is a perspective view of a non-recirculating heated air source and frozen food package clamp.

Figure 11:
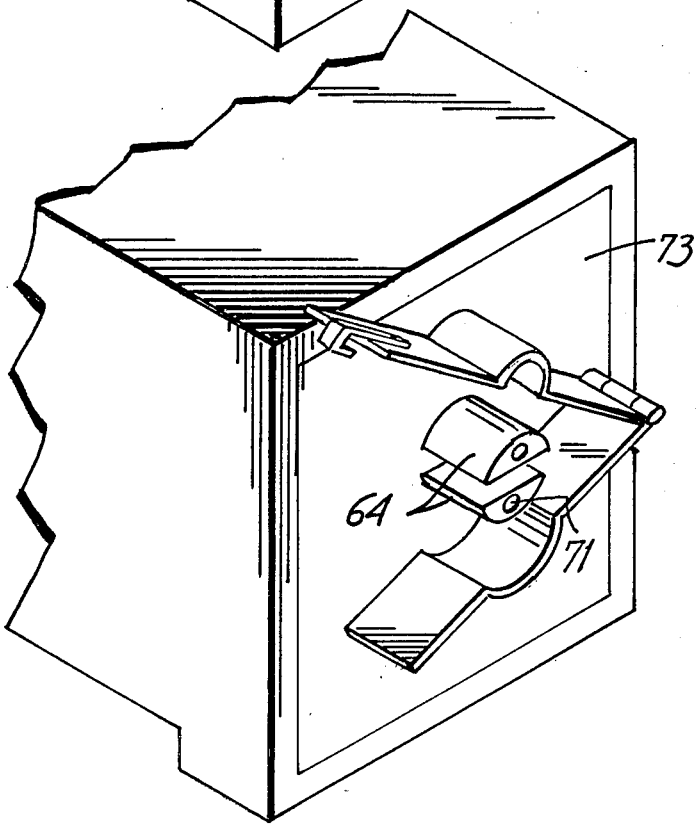

FIG. 11 is a perspective view of a recirculating heated air source and clamp.

Figure 12:
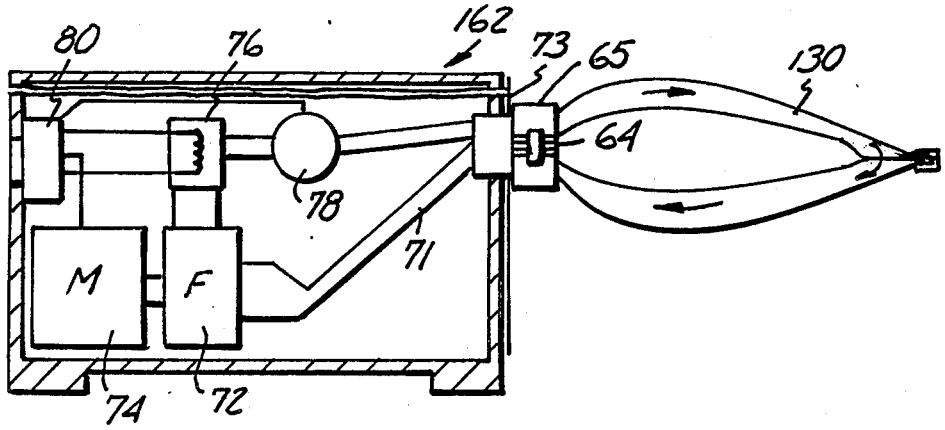

FIG. 12 is a schematic of a forced heated air source used with a recirculation package.

DETAILED DESCRIPTION OF THE PREFERRED EMBODIMENT

FIG. 1 illustrates a first preferred embodiment of a package 10 suitable for use in the present invention. Package 10 includes a bag 11 constructed of a flexible sheet material such as a heavyweight paper. Bag 11 is sealed at ends 12 and 14. Sealed end 12 is removable allowing bag 11 to be openable between crease lines 13*a* and 13*b* so that the bag can be temporarily sealed to an outlet of heated forced air (shown in FIG. 8).

Crease lines 13*a* and 13*b* demark pleats 16 and 18 which unfold from the interior of bag 11. Unfolding of pleats 16 and 18 occurs under air pressure provided by the source of heated, forced air, and results in expansion of the interior of bag 11 into a circulation plenum (shown in FIGS. 2*a* and 2*b*). In the embodiment of package 10, food is stored directly in the plenum. Expansion of the plenum allows the food to tumble freely during cooking.

Bag 11 further includes a plurality of restricted air outlets 20 adjacent edge 14. Outlets 20 provide an exhaust vent for the forced heated air at the distal end of bag 11. Thus air can circulate fully through bag 11. For shipping, sealed edge 12 is in place and exhaust outlets 20 are closed to prevent contamination of food. Outlets 20 are covered by a removable tape 22.

Bag 11 is weakened along perforation 23 adjacent sealed end 12 allowing the bag to be easily torn open and connected to a source of forced hot air.

Figure 2A:
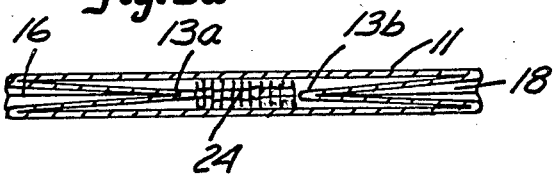
Figure 2B:
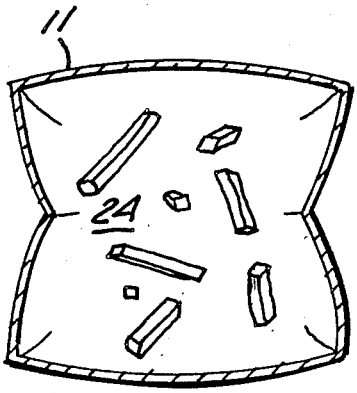

FIGS. 2*a* and 2*b* illustrate a circulation plenum 24 formable in bag 11. Food stuffs 26 such as frozen french fried potatoes are disposed inside bag 11 between creases 13*a* and 13*b*. Under air pressure, creases 13*a* and 13*b* unfold resulting in opening of plenum 24.

Figure 3A:
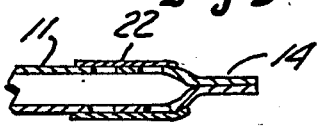
Figure 3B:
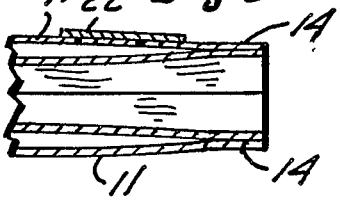

FIGS. 3*a* and 3*b* illustrate sealed edge 14 of bag 11, both as centered and along pleat 16.

FIG. 4 illustrates removable tape 22 in a state of partial removal from bag 11 over exhaust holes or vents 20. Tape 22 prevents entry of foreign matter to plenum 24 of bag 11 during shipping. Exhaust holes 20 are small enough, so that under normal air flow from the source of heated air, bag 11 inflates under a certain minimum pressure.

FIG. 5 illustrates a package 30 according to a second embodiment of the invention. Package 30 includes a bag 32 constructed of paper or a similar flexible sheet material. Bag 32 is opened to allow temporary connection to a source of forced heated air. A sealed end has been removed along a perforation similar to perforation 23 in bag 11 to provide opened end 38. Opened end 38 leads to a first chamber in a circulating plenum (shown in FIG. 7) comprising two interconnected chambers. Surface 40 surrounding opened end 38 may be covered with a weak adhesive to aid in securing bag 32 to the outlet nozzle.

A plurality of vents 42 provide a connection between the ambient environment along back side 44 of bag 32 to a second chamber of the circulating plenum within the bag. The circulating plenum is divided into two chambers by a food pouch which is connected to the inner surface of back side 44 of bag 32.

FIG. 6 illustrates food pouch 48 as seen removed from the interior of bag 32. Food pouch 48 includes end extensions 50 which are adapted to be sealed within sealed end 36. Gaps between extensions 50 formed by indented sections 52 interconnect the two chambers formed within a bag by food pouch 48. Food pouch 48 is typically constructed of a thin foil, such as aluminum foil, which is a good conductor of heat.

Figure 7A:
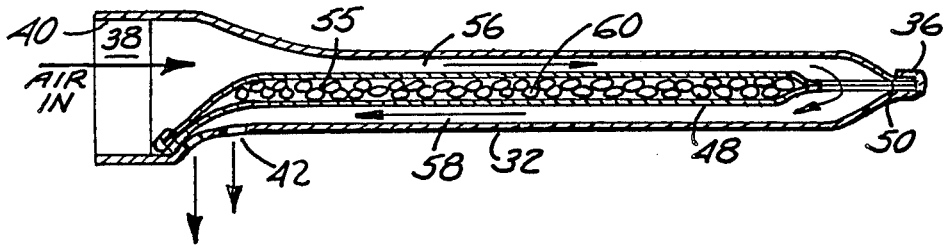

FIGS. 7*a* and *b* illustrate the positioning of food pouch 48 lengthwise in bag 32 between sealed end 36 and open end 34. Food pouch 48 divides plenum 55 into a first chamber 56 and a second chamber 58. Opened end 38 admits heated, forced air into first chamber 56. Air flows through chamber 56 from the proximate end of chamber 56 adjacent opened end 38 down the length of bag 32 to the distal end thereof adjacent sealed end 36. Forced air flows further through the gaps formed by indented sections 52 (shown in FIG. 6) into chamber 58. Again heated forced air passes along the substantial portion of the length of bag 32 to exhaust vents 42, which are near, but not adjacent and separated from, opened end 38. A portion of one extension 50 in sealed end 36, or some other boundary surface between food pouch 48 and bag 32 is weakened. During cooking, gases and food stuffs can undergo substantial expansion (see particularly FIG. 7*b*). Because food pouch 48 is sealed, it must expand to compensate for such expansion. Near the maximum expanded state of food pouch 48, the weakened boundary opens allowing air to enter the interior of food pouch 32. This prevents the collapse of food pouch 32 after the source of heat is removed and the contents begin to cool and contract. Heat is conducted from the flowing air through the walls of food pouch 48 to frozen food stuffs 60, such as mixed popcorn and oil, stored therein. The weakened boundary can be torn open or expanded after cooking to prevent access to the cooked food.

FIG. 8 illustrates the positioning of food pouch 48 across the width of bag 32. Food pouch 48 is suspended by extensions 52 and 54 dividing the interior of bag 48 into chambers 56 and 58.

FIG. 9 illustrates an exemplary source of heated, forced air 62 adapted for use with packages 10 and 30. Package 10 (or package 30) is attached at outlet 64 by clamp 65. Outlet 64 is mounted on turning valve 66 permitting outlet 64 with back plate 69 to be rotated for tumbling food in package 10. Turning valve 66 rotates at about five revolutions per minute and may be powered by an appropriate motor and step down drive train.

Outlet 64 provides forced, heated air to package 10 by drawing ambient air from inlet 70 of heating unit 62. Air is drawn by a centrifugal fan 72 powered by a motor 74. Fan 72 forces air through a heating coil 76, the temperature of which is indirectly controlled by a thermostat disposed in the air path between the heating coil and turning valve 66.

A control unit 80 monitors thermostat 78 and receives external input signals for actuating and controlling heating unit 62. Heating source 62 thus provides both forced, heated air and rotation to package 10 or 30. Packages 10 and 30 in effect are disposable ovens which can be used to ship food products.

FIG. 10 illustrates clamp 65 disposed on back turning plate 69 around with outlet 64 usable to secure a package 10 or 30 to a heating source. Arms 84 and 86 are hinged together by hinge 88. A clip 90 is provided for locking arms 84 and 86 in a closed position around outlet 64. A package 10 or 30 fitted to outlet 64 is thus firmly held to the outlet. Outlet 64 rotates with rotating valve 66 and back plate 69 causing the food in package 10 or 30 to be tumbled during cooking, further insuring even heating.

FIG. 11 illustrates a modified outlet 64 which includes inlet 70 for the air path through heating source 62. Heated air may be recirculated where energy consumption is to be kept to a minimum. Recirculation can be used in connection with package 30 to avoid exhausting heated air directly into a room. Exhaust vents 42 in package 30 require modification to deliver air directly to inlet 70 for recirculation. Modified outlet 64 is mounted to heating source 62 with a modified nonrotating back plate 73.

FIG. 12 illustrates an exemplary recirculating heat source 162 used with package 130 as modified for recirculation. Only the difference between heating source 162 and heating source 62 will be described. Air intake 70 has been replaced by recirculating loop 71 from outlet 64, providing a path from modified package 130 to centrifugal fan 72. Turning valve 66 has been removed and air circulation piping introduced connecting outlet 64 directly into the circulation path. The recirculation loop is sufficiently porous to compensate for air expansion and contraction.

The present invention provides what are essentially disposable convection ovens, and at little to no increase in cost of materials over conventional food packaging containers. The disposable ovens also provide the shipping packages for the frozen food. The cooking system provided by the packages of the present invention and the forced heated air source provide even cooking of food from its exterior surface inward and uniform browning of the exterior surface.

Although the present invention has been described with reference to preferred embodiments, workers skilled in the art will recognize that changes may be made in form and detail without departing from the spirit and scope of the invention.

What is claimed is:

1. A package for shipping of food and convection heating of the food when connected to a source of heated forced air comprising:

a flexible sheet folded into a bag having sealed top and bottom ends and having at least a first pleated edge connecting the top and bottom ends to allow expansion of the bag;

a charge of food within the bag;

a perforation running substantially parallel and adjacent to the sealed top end allowing removal of the sealed to end to provide a partially openable top end for temporary attachment to an outlet from the source of forced heated air for admitting forced air to the bag to form a plenum;

exhaust holes in the sheet sized to provide a partially restricted outlet for air from the plenum and positioned with respect to the top end to allow circulation of forced air through the plenum; and a removable tape for closing the exhaust holes.

2. The package as defined in claim 1 wherein the partially openable top end has a circular shape for fitting around an outlet.

3. The package as defined in claim 2 wherein the exhaust holes are disposed substantially adjacent the bottom end of the bag.

4. The package of claim 3 wherein the bag is constructed of paper.

5. The package of claim 2 and further comprising a pouch for holding food disposed within the bag.

6. The package of claim 5 wherein the pouch has a bordering edge and is fixed along a substantial portion thereof to the interior of the bag for dividing the plenum into first and second chambers.

7. The package of claim 6 wherein the pouch is positioned so that the first chamber begins adjacent the top end.

8. The package of claim 7 wherein the exhaust holes are spaced from the bottom end and connect the second chamber of the plenum to the exterior of the bag.

9. The package of claim 8 and further comprising openings between the first and second chambers adjacent the bottom end of the bag defining a circulation route through the plenum beginning with the first chamber and leading to the second chamber.

10. The package of claim 9 wherein the pouch is constructed of an expansible sheet material which is a good conductor of heat.

11. The package of claim 10 wherein the pouch material is aluminum foil.

* * * * *

UNITED STATES PATENT AND TRADEMARK OFFICE

CERTIFICATE OF CORRECTION

PATENT NO. : 4,904,489

DATED : February 27, 1990

INVENTOR(S) : Bert R. Bach

It is certified that error appears in the above-identified patent and that said Letters Patent is hereby corrected as shown below:

Column 6, line 3, delete "to" and insert --top--.

Signed and Sealed this

Twenty-fifth Day of June, 1991

*Attest:*

*Attesting Officer*

HARRY F. MANBECK, JR.

*Commissioner of Patents and Trademarks*